US005425262A

United States Patent [19]

Dubugnon

[11] Patent Number: 5,425,262

[45] Date of Patent: Jun. 20, 1995

[54] METHOD AND AN APPARATUS FOR CARRYING OUT AN OPERATION ON A MECHANICAL WORKPIECE

[75] Inventor: Olivier Dubugnon, Vullierens, Switzerland

[73] Assignee: Attexor Equipements S.A., Ecublens, Switzerland

[21] Appl. No.: 958,332

[22] PCT Filed: Apr. 22, 1992

[86] PCT No.: PCT/EP92/00891

§ 371 Date: Feb. 22, 1993

§ 102(e) Date: Feb. 22, 1993

[87] PCT Pub. No.: WO92/18264

PCT Pub. Date: Oct. 29, 1992

[30] Foreign Application Priority Data

Apr. 23, 1991 [SE] Sweden ..... 9101225

[51] Int. Cl.[6] ..... B21J 9/18

[52] U.S. Cl. ..... 72/450; 72/407; 72/455; 100/228

[58] Field of Search ..... 72/410, 450, 455, 407; 100/228, 231, 233

[56] References Cited

U.S. PATENT DOCUMENTS

| | | | |
|---|---|---|---|
| 1,343,872 | 6/1920 | Livering | 100/228 |
| 1,354,517 | 10/1920 | Sollazzo | 100/228 |
| 2,765,019 | 10/1956 | Evans | 72/455 |
| 3,422,750 | 1/1969 | Anderson | 72/455 |
| 3,496,967 | 2/1970 | Timmerbeil | 140/93.2 |
| 4,329,867 | 5/1982 | Nelson | 72/455 |
| 4,878,374 | 11/1989 | Nelson | 72/455 |

FOREIGN PATENT DOCUMENTS

| | | | |
|---|---|---|---|
| 556553 | 4/1957 | Belgium . | |
| 455193 | 1/1928 | Germany | 100/228 |
| 538368 | 10/1931 | Germany | 100/228 |

*Primary Examiner*—David Jones
*Attorney, Agent, or Firm*—Mark P. Stone

[57] ABSTRACT

Method and Apparatus for carrying out an operation, such as pressing, riveting, cutting, etc., on a mechanical workpiece which operation comprises at least one stroke, or movement, along a predetermined path, of at least two active members (6,7) each being arranged on a carrying unit (1,2). The mechanical workpiece is first positioned between the active members (6,7). Thereafter the carrying units (1,2) for the active members are approached to each other in a first part of the stroke. The carrying units (1,2) are then locked to each other at the end of said first part of said stroke and a second part of said stroke is carried out by way of the relative movement between the active members (6,7) to achieve the desired effect on the said workpiece.

15 Claims, 3 Drawing Sheets

METHOD AND AN APPARATUS FOR CARRYING OUT AN OPERATION ON A MECHANICAL WORKPIECE

TECHNICAL FIELD

This invention relates to apparatuses for carrying out operations on a mechanical workpiece e.g. tools or machines for pressing, riveting, clinching, cutting etc. The tools and machines could be of stationary or hand-held type. The power source could be of any type, hydraulic, pneumatic, electric etc.

BACKGROUND ART

One type of tool belonging to the category defined above is previously known from the International patent application W089/07020.

According to the principle of the tool described in said patent application a pair of overlaying metal sheet members are joined together by lancing and forming a part of one member through an unblanked part of the other member. Thereafter a staking procedure is carried out on the lanced and formed part of the one member to an adjacent surface of the other member to secure the members together in overlaying relation.

Typically this type of tools or machines provide very high forces during the joining procedure, the opening, or gap, for introducing the workpieces is relatively narrow and the strokes carried out by the active machine elements are short and fast.

On one hand a narrow gap and short stroke could be chosen in order to give the tool a fast operation which of course gives a more efficient tool with more joints per unit time. On the other hand the same parameters are of course limiting the form and dimensions of the workpiece which could be operated on by the tool.

If, on the other hand a wider gap and longer stroke are chosen, without any compromise on the time for making a joint, the tool will require a more powerful drive unit. The implementation of this idea thus implies costs at two levels: investment costs for a larger high-power drive installation and higher energy costs for the operation of the tool.

DISCLOSURE OF THE INVENTION

One object of the present invention is to provide a method and a machine for pressing, riveting, clinching, cutting etc. which is fast and efficient and possible to use on workpieces with different geometries and much larger dimensions than heretofore.

Another object of the invention is to provide a tool which meets the requirements according to the above still being so light and compact that it could be used as a versatile hand-held tool.

The inventive idea takes into consideration the fact that when making one of the above mentioned operations, pressing, clinching, riveting, inserting, cutting etc. the total active force is only needed for a short part of the stroke of the tool. The rest of the stroke is needed for approaching the active parts of the tool to the point of operation.

The present invention, which provides a solution to the said technical problems, is characterised according to the appended claims.

BRIEF DESCRIPTION OF THE FIGURES

Other objects, uses and advantages of this invention will be apparent from the reading of this description which proceeds with reference to the accompanying drawings forming part thereof and wherein.

DETAILED DESCRIPTION OF THE INVENTION

Figure 1:
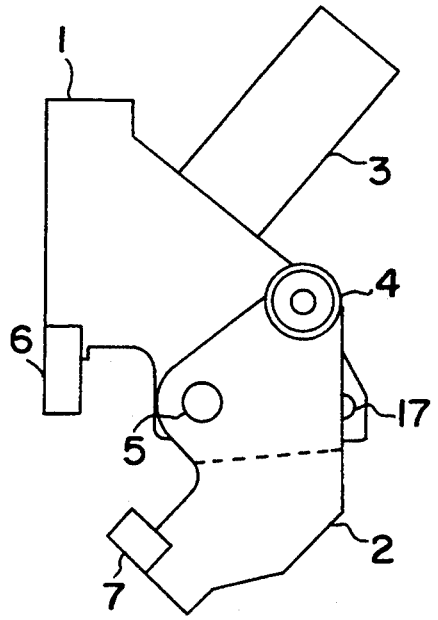
FIG. 1 schematically shows an apparatus according to the present invention implemented as a hand-held tool.

FIG. 1 shows schematically an apparatus according to the present invention implemented as a hand-held tool. The principles of the invention are, however, applicable to stationary equipment as well, as will be described below. The tool-body has two main parts 1 and 2 each provided with a handle 3 and 4 respectively and carrying an active part 6, 7. These handles are, in the shown example, arranged with their axes perpendicular to each other. The two parts 1 and 2 of the tool-body are articulated in relation to each other by means of a bearing 5, here shown as a simple pin. The active parts of the tool, e.g. a punch and a die have been represented schematically with the units 6 and 7 in the figure. At least one of the parts 1 and 2 is provided with an actuating system for the corresponding active part 6 or 7 of the tool so that a relative movement can be produced between these parts during the operation of the tool. Such a system could e.g. include an hydraulic or pneumatic cylinder-piston assembly.

The tool is of course connected to a power and control system which could be of the same type as described in the International application W089/07020 and the main trigger could be arranged on the handle 3.

In the position, shown in FIG. 1, the gap between the active parts 6, 7 of the tool has its maximum width and workpieces with different geometries and large dimensions can be entered into the gap.

Figure 2:
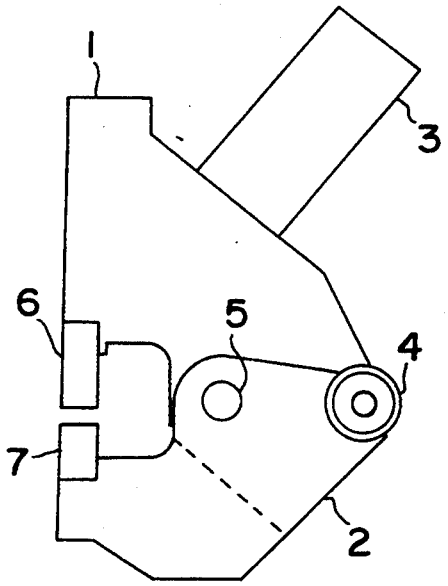
FIG. 2 shows the same tool positioned for the active part of the stroke.

In FIG. 2 the same tool has been positioned for the active part of the stroke. The operator of the tool has by means of pressing the handle 4 downwards rotated the part 2 of the tool around the pin 5 in an approaching movement of the active parts 6 and 7 and locked the part 2 in a predetermined fixed position relative to the part 1 of the tool. A few examples of the locking mechanism will be described more in detail below.

Figure 3:
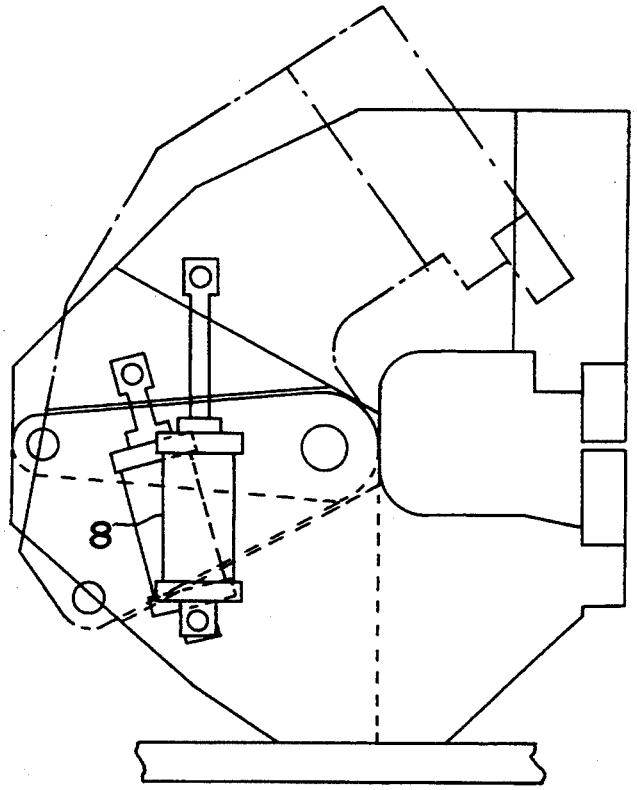
FIG. 3 shows an implementation of the invention as a stationary machine.

The relative position of the handle 4, the bearing 5 and the active part 7 on the part 2 of the tool-body, as shown in the figure, makes it possible to design the part 2 mechanically balanced around the bearing 5. This means that the force needed to carry out this approaching movement will be very low and the movement can be very fast irrespective of the orientation of the tool even when the movement is manual as in this example. In FIG. 3 is illustrated how this approaching movement can be assisted by means of an actuator in the form of a pneumatic or hydraulic cylinder-piston assembly. A corresponding arrangement could of course be used on the manual tool as well.

Thus, according to the inventive idea the complete stroke or movement between the active parts 6 and 7 during one operation of the tool for pressing, riveting, clinching etc. has been divided into two parts. A first part which is an approaching stroke or movement and a second part which is an active stroke or movement. Therefore, the power-part of the drive system, hydraulic, pneumatic, electric etc. can be designed taking into account the requirements of the active stroke or movement only. The other part of the complete stroke which with a good design of the tool typically requires less than 1/1000 of the force of the active stroke can be carried out manually, as described above, or assisted by means of an actuator.

A further advantage with the invention is that since the pressing or cutting process etc, i.e. the tool operation during the second part of the stroke, is carried out when the articulation is blocked, the main bearing 5 is submitted only to static load which means that the wear at this joint is very low compared to bearings in conventional pinch tools operating under load. This also means that a complex bearing design can be avoided. For many applications a simple pin, as shown in the schematic figures, would be sufficient. The approaching part of the movement is in this example defining a plane which will also include the trajectory for the second part of the stroke. The inventive idea, however, also comprises embodiments in which this is not the case. The first and second parts of the movement could e.g. define trajectories for the active parts 6, 7 in planes perpendicular to each other or with other angular relations.

As already mentioned FIG. 3 shows an implementation of the invention as a stationary machine. The approaching movement is here carried out by means of the actuator 8 but could alternatively be carried out manually or manually with an assisting actuator.

Figure 4:
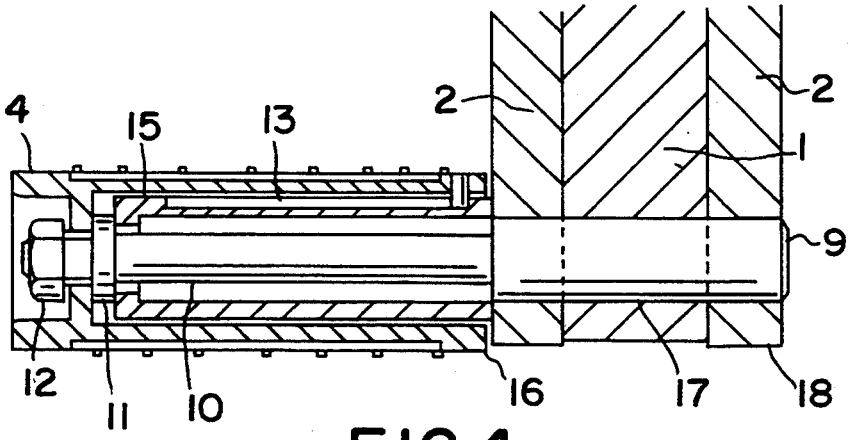
FIG. 4 shows one of the handles on a hand-held tool with an integrated locking mechanism.

FIG. 4 shows the handle 4 on a hand-held tool according to FIGS. 1 and 2 with an integrated locking mechanism. A handle support 15 in the form of a cylindrical tube is arranged on the side of the part 2 of the tool-body, essentially perpendicularly to the same and coaxially with a through hole 18 in this part 2. An external coaxial part 16 of the handle is axially and rotationally movable on the handle support 15. Inside the handle support a locking pin 9, having an extension shaft 10, is coaxially arranged to slide axially inside the handle support and the corresponding through hole 18. The extension shaft 10 of the locking pin is fixed to the external part 16 of the handle so that it follows the axial movement of the same.

Thus, when the external part 16 of the handle is moved axially on the handle support the locking pin will follow this movement inside the support and the corresponding through hole.

In the tool position illustrated in FIG. 2, i.e when the active parts 6 and 7 have the correct positions for the second part of the stroke, the parts 1 and 2 of the tool should be locked to each other. Therefore, part 1 of the tool is provided with a through hole 17 coinciding with the hole 18 in this position, so that the locking pin 9 by means of the external part 16 of the handle could be pushed through the coinciding holes in the parts 1 and 2 and lock the same to each other. This locking procedure could also be seen from FIG. 5.

Figure 5:
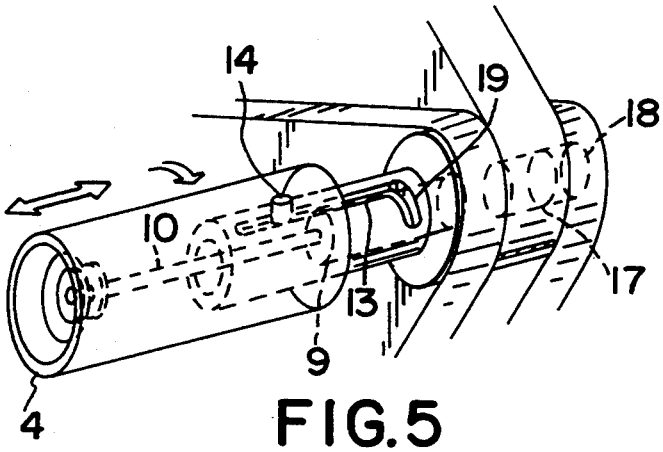
FIG. 5 illustrates in perspective the locking mechanism of the handle according to FIG. 4.

In FIG. 5 it is shown how the handle support has been provided in the external surface with a groove, having one part 13 parallel to the axis of the support and one part 19 in a direction essentially perpendicular to said axis. On the inner surface of the external part 16 of the handle a guide pin 14 cooperating with said groove has been arranged. This means that at the end of the locking procedure achieved by means of the axial movement of the external part of the handle, this part could be rotated in order to block any subsequent, inadvertent axial movement which could again release the locking during or just before the second part of the stroke.

The blocking of the inadvertent axial movement could of course be realized in different ways e.g. by means of a snap mechanism active at the end of the linear movement which mechanism could be released by means of a trigger.

Additionally a safety valve, (not shown), or a contact in an equivalent electrical control system, could be arranged e.g. on part 2 of the tool opposite to the handle 4 operated by the locking pin when this is correctly positioned. This safety valve enables the main trigger circuit for the active stroke so that this could only be carried out when the locking is safe.

A spring (not shown) could of course easily be arranged inside the handle support to push the pin 9 through the coinciding holes 17 and 18. This would also add to the security of the system.

Figure 6:
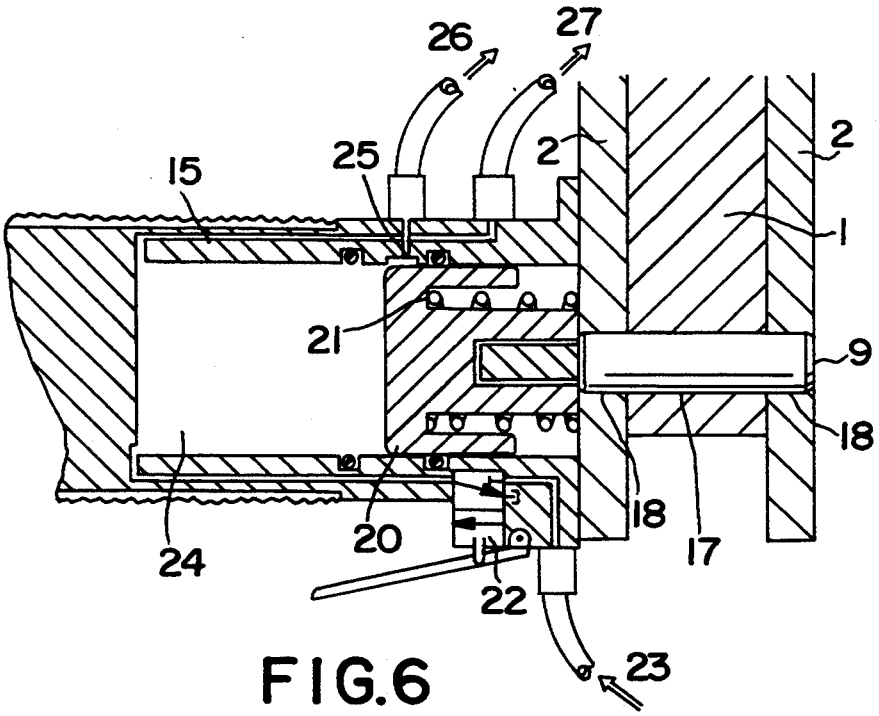
FIG. 6 shows a further implementation of a handle of a hand-held tool and FIGS. 7 to 10 show further embodiments of the locking mechanism.
Figure 7:
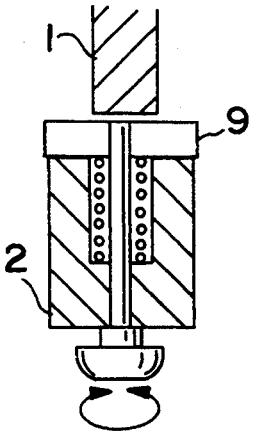
Figure 8:
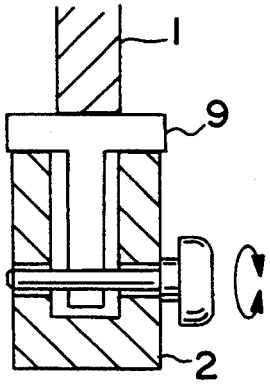
Figure 9:
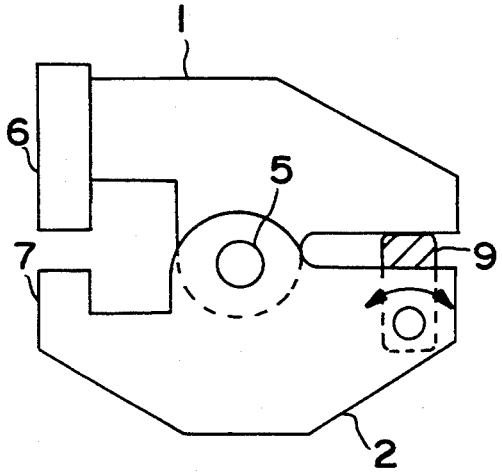
Figure 10:
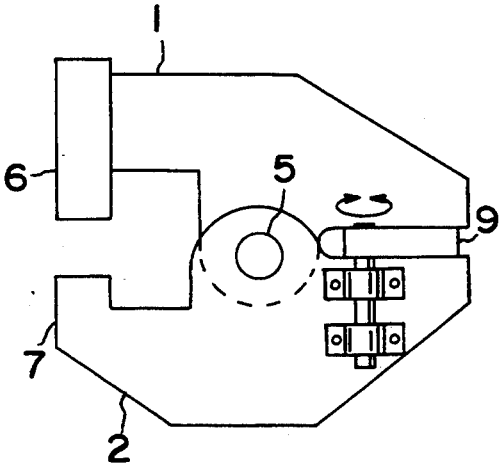

FIG. 6 shows another embodiment of the handle 4 of a hand-held tool. Corresponding parts have been given the same designations. The handle support 15 has in this embodiment been given the form of a pneumatic cylinder in which a spring loaded piston 20, carrying the locking pin 9, is arranged for axial movement. In its initial position the piston 20 is retracted into the support by means of a spring 21 so that the through hole in part 1 of the tool-body is free. The support is also provided with an integrated trigger valve 22.

Air pressure is entered through the inlet 23 to the trigger valve 22. When the valve is operated the air will enter the volume 24 behind the piston and move the same to the right in the figure against the force of the spring 21. When the through holes in the parts of the tool-body coincide the pin 9 will enter the holes and lock the parts 1 and 2 to each other. At the same time the piston will open an enabling-valve transferring pressure from the volume 24 through the outlet 26 to the main trigger circuit. Thus, the active part of the tool operation cannot start before the tool is safely locked.

In FIG. 6 is also shown how an assisting pneumatic actuator, of the type shown in FIG. 3 for a stationary machine, could be powered on a hand-held tool from the handle 4. Thus, the volume 24 communicates with an outlet 27 to an assisting cylinder-piston assembly which will move, or help to move, the parts 1 and 2 of the tool into their relative position for the final part of the stroke, in which position the locking takes place.

Other types of mechanical locking mechanisms could of course be envisaged, e.g. different types of spacers to be inserted between corresponding parts on parts 1 and 2 of the tool when positioned for the active part of the stroke. A few such mechanisms are shown in the FIGS. 7 to 10. The drive system for these locking mechanisms could be of any type, e.g. manual, electrical, hydraulic etc.

As an alternative an hydraulic locking mechanism, having a cylinder-piston assembly arranged e.g. in the same way as the assisting actuator of FIG. 3, could be used. When the flow of incompressible fluid to such an assembly is blocked, this arrangement will lock the tool in the position for the second part of the stroke.

As mentioned above it is essential to keep at a minimum the operation time for one single stroke in order to reach the over all high efficiency of the tool. Therefore, the opening of the tool to receive the workpiece should not be excessive but preferably adaptable to the actual dimensions of the workpiece. A system for limiting the width of the opening of the tool e.g. making use of the components of the locking mechanism could be arranged.

Thus with a tool design according to the above a fast approach movement of the tool will be achieved which drastically reduces the time per operation and makes it possible to use cost effective power supplies, the active parts 6, 7 for pressing, punching, cutting etc. could be made with standard components, the tool-body 1,2 can easily be adapted, e.g. my replacement of the part 2, to the geometry of the current application, the articulation and locking mechanisms are only submitted to static loads.

I claim:

1. An apparatus for carrying out an operation on a mechanical workpiece; said operation comprising at least one stroke, or movement, along a predetermined path, of at least a first active tool-member (6, 7) towards a cooperating second tool-member (6, 7), said first and second tool-members arranged on first and second tool-carrying members (1, 2) movable relative to each other in a pivotal movement around a pivotal connection (5) in a first part of said at least one stroke; said apparatus further comprising a locking mechanism (9, 17, 18) for locking said relative movement between said first and second tool-carrying members at the end of said first part of said stroke; said apparatus characterized in that said pivotal connection (5) is arranged in a position between 1). said first and second tool-members (6, 7) and 2). said locking mechanism (9, 17, 18), said position of said pivotal connection (5) being proximate to the center of gravity of one of said first and second tool-carrying members.

2. Apparatus according to claim 1 characterized in that one of said first and second tool-carrying members (1, 2) is mechanically balanced relative to an axis of the pivotal connection (5).

3. Apparatus according to claim 1 characterized in that said apparatus comprises a handle (3, 4) on one of said first and second tool-carrying members (1, 2) for hand operation of said apparatus.

4. Apparatus according to claim 3 characterized in that said handle (4) comprises a handle support (15) arranged on a side of one of said first and second tool-carrying members and oriented essentially perpendicular thereto and having an axis parallel to the axis of a through hole (18) defined in said one of said first and second tool-carrying members and a through hole (17) defined in the other of said first and second tool-carrying members and coinciding with the hole in said one of said first and second tool-carrying members at the end of said first part of said first stroke; an external coaxial part (16) axially movable on said handle support (15); a locking pin (9) arranged in said handle support (15) and having an extension shaft (10) arranged to slide axially inside said handle support (15) and inside said through holes defined in said first and second tool carrying members; said extension shaft (10) of said locking pin (9) being fixed to said external coaxial part of said handle such that said extension shaft follows the axial movement of said external part of said handle so that said locking pin is receivable in said coinciding through holes defined in said first and second tool-carrying members for locking said tool-carrying members in a predetermined relative position at the end of said first part of said stroke.

5. Apparatus according to claim 3 characterized in that said locking mechanism is integrated into said handle.

6. Apparatus according to claim 5 characterized in that said handle (4) comprises a handle support (15) arranged on a side of one of said first and second tool-carrying members and oriented essentially perpendicular thereto and having an axis parallel to the axis of a through hole (18) defined in said one of said first and second tool-carrying members and a through hole (17) defined in the other of said first and second tool-carrying members and coinciding with the hole in said one of said first and second tool-carrying members at the end of said first part of said first stroke; an external coaxial part (16) axially movable on said handle support (15); a locking pin (9) arranged in said handle support (15) and having an extension shaft (10) arranged to slide axially inside said handle support (15) and inside said through holes defined in said first and second tool carrying members; said extension shaft (10) of said locking pin (9) being fixed to said external coaxial part of said handle so that said extension shaft follows the axial movement of said external part of said handle so that said locking pin is receivable in said coinciding through holes defined in said first and second tool-carrying members for locking said tool-carrying members in a predetermined relative position at the end of said first part of said stroke.

7. Apparatus according to claim 6 further including a safety valve arranged on a part of one of said first and second tool-members opposite to said handle, said safety valve being controlled by said locking pin when said locking pin is in a locked position; said safety valve being operatively associated with a main trigger circuit for enabling an active stroke only when said locking pin is in said locked position.

8. Apparatus according to claim 7 characterized in that said handle support (15) comprises an axially movable actuator for carrying said locking pin (9).

9. Apparatus according to claim 6 characterized in that said handle support (15) comprises an axially movable actuator for carrying said locking pin (9).

10. Apparatus according to claim 9 characterized in that said actuator is a pneumatic cylinder including a spring-loaded piston (20) for carrying said locking pin (9).

11. Apparatus according to claim 6 further including means for rotationally moving said external coaxial part (16) on said handle support (15); a groove defined in an external surface of said handle support (15) having a part (13) parallel to an axis of said handle support and having a part (19) oriented in a direction essentially perpendicular to said axis of said handle support; a guide pin (14) arranged on an inner surface of said external part (16) of said handle and cooperating with said groove such that at the end of a locking procedure resulting from axial movement of said external part of said handle (16), said external part (16) is rotatable for blocking subsequent, inadvertant axial movement to prevent release of said lock of said first and second tool-carrying members to each other during or prior to a second part of said stroke.

12. Apparatus according to claim 11 characterized in that said handle support (15) comprises an axially movable actuator for carrying said locking pin (9).

13. Apparatus according to claim 11 further including a safety valve arranged on a part of one of said first and second tool-members opposite to said handle, said safety valve being controlled by said locking pin when said locking pin is in a locked position; said safety valve being operatively associated with a main trigger circuit for enabling an active stroke only when said locking pin is in said locked position.

14. Apparatus according to claim 1 wherein said operation on said mechanical workpiece by said apparatus includes joining together two or more overlaying sheet formed members.

15. Apparatus as claimed in claim 14 wherein said sheet formed members to be joined together by said apparatus are positioned between said first and second tool-members (6, 7) during said operation.

* * * * *

UNITED STATES PATENT AND TRADEMARK OFFICE

CERTIFICATE OF CORRECTION

PATENT NO. : 5,425,262

DATED : June 20, 1995

INVENTOR(S) : Olivier Dubugnon

It is certified that error appears in the above-identified patent and that said Letters Patent is hereby corrected as shown below:

Column 2, Line 61: After "bearing 5", add

- -by arranging the bearing 5 in a position proximate to the center of gravity of the part 2- -.

Signed and Sealed this

Fifth Day of September, 1995

*Attest:*

*Attesting Officer*

Bruce Lehman

BRUCE LEHMAN

*Commissioner of Patents and Trademarks*